US011369842B2

(12) United States Patent
Kelberman

(10) Patent No.: US 11,369,842 B2
(45) Date of Patent: Jun. 28, 2022

(54) FOOT EXERCISE APPARATUS

(71) Applicant: Jason Kelberman, Los Angeles, CA (US)

(72) Inventor: Jason Kelberman, Los Angeles, CA (US)

( * ) Notice: Subject to any disclaimer, the term of this patent is extended or adjusted under 35 U.S.C. 154(b) by 0 days.

(21) Appl. No.: 16/551,344

(22) Filed: Aug. 26, 2019

(65) Prior Publication Data

US 2020/0061411 A1 Feb. 27, 2020

Related U.S. Application Data

(60) Provisional application No. 62/765,403, filed on Aug. 24, 2018.

(51) Int. Cl.

| | |
|---|---|
| ***A63B 23/10*** | (2006.01) |
| ***A63B 21/02*** | (2006.01) |
| ***A63B 21/00*** | (2006.01) |
| ***A63B 21/055*** | (2006.01) |
| ***A63B 21/04*** | (2006.01) |
| ***A63B 21/008*** | (2006.01) |
| ***A63B 23/08*** | (2006.01) |

(52) U.S. Cl.

CPC ..... *A63B 23/10* (2013.01); *A63B 21/00069* (2013.01); *A63B 21/0083* (2013.01); *A63B 21/023* (2013.01); *A63B 21/0428* (2013.01); *A63B 21/0552* (2013.01); *A63B 23/08* (2013.01); *A63B 2209/00* (2013.01)

(58) Field of Classification Search

CPC ..... A63B 23/08–10; A63B 2023/006; A63B 21/002–0023; A63B 21/02–0557; A63B 21/4013; A63B 21/4015; A63B 23/32

See application file for complete search history.

(56) References Cited

U.S. PATENT DOCUMENTS 2,638,089 A 5/1953 Murphy
3,430,956 A * 3/1969 Borgeas ..... A63B 23/085 482/79

(Continued)

OTHER PUBLICATIONS

IRS and Written Opinion PCT/US19/48175.

*Primary Examiner* — Nyca T Nguyen
(74) *Attorney, Agent, or Firm* — J D Harriman; Foundation Law Group LLP

(57) ABSTRACT

The device is a foot power apparatus which provides a means for therapeutically strengthening the foot using an expansion spring mounted pedal suspended within a support frame assembly. One embodiment of the apparatus comprises which base, which generally resembles the sole of a shoe, and a support frame assembly which is attached at the front end and along the sides of said base. Suspended above the base within the frame assembly by a pair of opposing springs is a pedal transversely positioned to the base. With the user's foot positioned on the base, the front of the foot applies downward pressure to expand the springs while the heel of the foot remains stationary. Removable and interchangeable expansion springs provide customized and more accurate biomechanical motion for the needs of the particular patient. This system allows for the proper flexion biomechanics on an individual basis because of its ability to shorten the foot during the flexion process.

5 Claims, 3 Drawing Sheets

(56) References Cited

U.S. PATENT DOCUMENTS 3,524,644 A * 8/1970 Kane ..... A63B 21/023 482/129
3,640,529 A * 2/1972 Kane ..... A63B 21/023 482/129
3,942,791 A 3/1976 Dawson
5,160,303 A * 11/1992 Smith ..... A63B 21/055 482/123
5,322,492 A * 6/1994 Pearson ..... A63B 23/0211 482/121
5,433,684 A 7/1995 Carrillo
5,556,359 A * 9/1996 Clementi ..... A63B 23/16 482/123
5,851,166 A * 12/1998 Bernardson ..... A63B 23/03533 482/79
5,984,841 A * 11/1999 John ..... A63B 22/0056 482/52
6,796,928 B1 * 9/2004 Christopher ..... A63B 22/0056 482/123
7,578,774 B1 8/2009 Zetterberg
7,794,367 B2 9/2010 Hall
D631,107 S * 1/2011 Gillis ..... D21/685
9,776,030 B1 * 10/2017 Louis ..... A63B 21/068
2014/0128228 A1 * 5/2014 Bonomi ..... A63B 23/03525 482/98
2014/0187388 A1 * 7/2014 Rogoff ..... A63B 21/0442 482/79
2016/0206920 A1 * 7/2016 Gillis ..... A63B 21/0414
2016/0339296 A1 * 11/2016 Barel ..... A63B 21/4034
2017/0021226 A1 * 1/2017 Adams ..... A63B 23/03508
2017/0326401 A1 11/2017 Durket
2019/0224031 A1 * 7/2019 Dunca ..... A63B 21/4034

* cited by examiner

FOOT EXERCISE APPARATUS

This patent application claims priority to U.S. Provisional Patent Application Ser. No. 62/765,403 filed on Aug. 24, 2018, which is incorporated by reference herein in its entirety.

BACKGROUND OF THE SYSTEM

Foot injuries are among the most prevalent that people will experience. There are 26 bones, 30 joints and over 100 tendons, muscles and ligaments in the human foot. Because it is supporting the weight of the body both at rest when standing as well as when in motion, the weight, torsional impact and stress on the foot is extreme. These conditions lead to foot injuries, which most people experience at least once in their lifetimes.

Humans were designed to walk barefoot on softer surfaces such that we use the entire bottom of the foot, strengthening the bottom of the foot. Instead we wear shoes with no plantar flexion, on harder surfaces, which are not forgiving, causing atrophy in the muscles in the bottom of the foot (due to disuse). That leads to other problems in the foot, gait problems, and other problems with the ankle, knee, hip, etc. Some sort of exercise and/or therapy is needed to strengthen the foot and reduce correlating problems.

A rocker that has been used in the prior art as a therapy device comprises a platform having a rounded bottom surface which, when attached to the user's foot, rolls forward and aft, allowing the arch of the foot to be stretched. While some flexure of the fascia occurs during operation of these devices, the motion largely consists of rotational movement of the foot along the ankle bone, thus failing to provide plantar and toe flexion particularly or specifically address the biomechanical movement and issues relating to the fibrous tissue and surrounding tendons and muscles along the bottom of the foot.

A prior art therapy device referred to as the foot corrector comprises a foot pad and an elevated "saddle" plate connected to spring stations above the foot pad and upon which the user's foot is placed. With the heel remaining stationary, the ball and toes of the foot compress the spring mounted saddle in a downward motion, thereby allowing the arch of the user's foot to be stretched. This device operates with a pedal or plate affixed to pair of permanently affixed compression springs. The resistance cannot be adjusted to individual needs and the force applied to compressing a spring must be more precise in order to avoid collapsing the coils.

SUMMARY

The device is a foot power apparatus which provides a means for therapeutically strengthening the foot using an expansion spring mounted pedal suspended within a support frame assembly. One embodiment of the apparatus comprises which base, which generally resembles the sole of a shoe, and a support frame assembly which is attached at the front end and along the sides of said base. Suspended above the base within the frame assembly by a pair of opposing springs is a pedal transversely positioned to the base. With the user's foot positioned on the base, the front of the foot applies downward pressure to expand the springs while the heel of the foot remains stationary. Removable and interchangeable expansion springs provide customized and more accurate biomechanical motion for the needs of the particular patient. This system allows for the proper flexion biomechanics on an individual basis because of its ability to shorten the foot during the flexion process.

DETAILED DESCRIPTION OF THE SYSTEM

The system comprises a plantar flexion apparatus used for the purpose of therapeutic treatment of foot injuries and strengthening the foot and connected muscles and tendons. The apparatus comprises a base having sides, a top surface and bottom surface, shaped generally like the sole of a shoe. In one embodiment the base is approximately one inch thick, designed to accommodate a foot up to size 14 and made of a plastic or polymer material. However, the apparatus may be made to accommodate any size foot.

Figure 1:
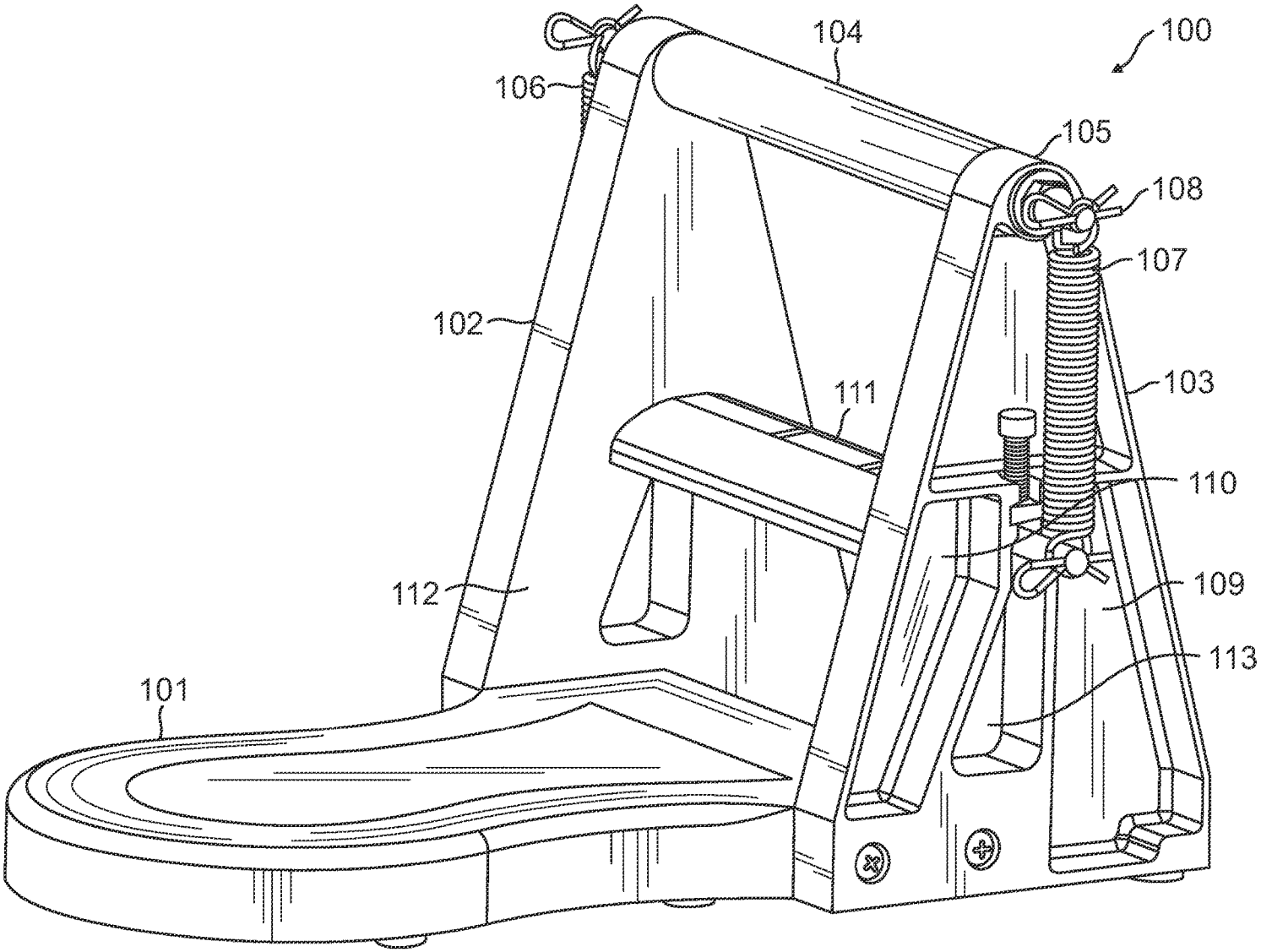
FIG. 1 is a perspective view of an embodiment of the apparatus.

FIG. 1 illustrates one embodiment of the apparatus 100. A support frame assembly ("Frame Assembly") is secured to the outer sides of the base 101 at an approximate location of the ball of the foot with reference to the shoe sole shape of the base. The Frame Assembly comprises a pair of opposing elongated vertical stanchions 102 and 103, approximating an isosceles triangular shape, which extend above the base 101. The top ends of each stanchion contain a centrally located aperture, opposing and in alignment with one another.

A cylindrical top cross member 104 extends between the stanchions in line with the apertures. A threaded upper shaft is insertably mounted through the apertures of the stanchions and through a top cross member, extending beyond the outer surfaces of the stanchions and secured with, for example, nuts 105 as shown in the drawings. In one embodiment, the top cross member and upper shaft provide stability to the support frame. These elements provide a means of securing urgent members in the form of a pair of expansion springs 106 and 107 which comprise a portion of the expansion pedal assembly ("Pedal Assembly") as shown in the drawings.

Each spring is approximately 4" long in one embodiment, but the length of the spring may be different depending on the size of the entire apparatus. One end of each spring is connected to the upper shaft as shown in FIG. 1. In one embodiment, the ends of each spring are coiled into loops, one of which is then placed over the upper shaft and secured by a cotter pin 108 through a small hole near the end of the shaft. Other means of securing the spring may be used. The other end of the spring is insertably positioned over a lower shaft and similarly secured with a cotter pin 109 as shown in FIG. 1. Springs of different tension and size may be used to specifically meet the needs of the individual without departing from the scope and spirit of the apparatus.

The lower shaft is positioned parallel to the upper shaft and extends through angular slots in each stanchion as shown in the drawings. The slots extend from a central position at the bottom of each stanchion angled in a forward direction, terminating approximately at the front of and at the midpoint of each stanchion as shown in the drawings.

The lower shaft 110 is insertably positioned through a pedal 111 as shown in the drawings. In one embodiment of the apparatus, the pedal is approximately 5" in length, 2" in width and a thickness of about one half inch. A longitudinal aperture runs lengthwise through the pedal through which the lower shaft is inserted. In position on the lower shaft, the pedal fits just inside the stanchions. The longitudinal aperture being larger in circumference than the lower shaft, the pedal can be rotated around the lower shaft as shown in the drawings.

During use, downward pressure is applied to the pedal 111 by the user, which pressure is resisted by the expansion springs 106 and 107. The lower shaft travels through the slots 112 and 113 in the stanchions as the pedal moves up and down. The angular configuration of the slots provide proper biomechanical motion of the foot.

The apparatus in one embodiment involves two interconnected component assemblies; the Frame Assembly and the Pedal Assembly. The Frame Assembly comprises the stanchions, the top cross member and the upper shaft. The Pedal Assembly comprises the springs, the lower shaft and pedal as described above. The user stands on the base. Keeping the heel on the base, the front of the foot is raised such that the metatarsalgia (ball of the foot) rests on the pedal. The user applies downward and posterior pressure to the pedal and the resulting resistance provides contraction of the muscles and strengthens muscles and tendons in the foot.

Figure 2:
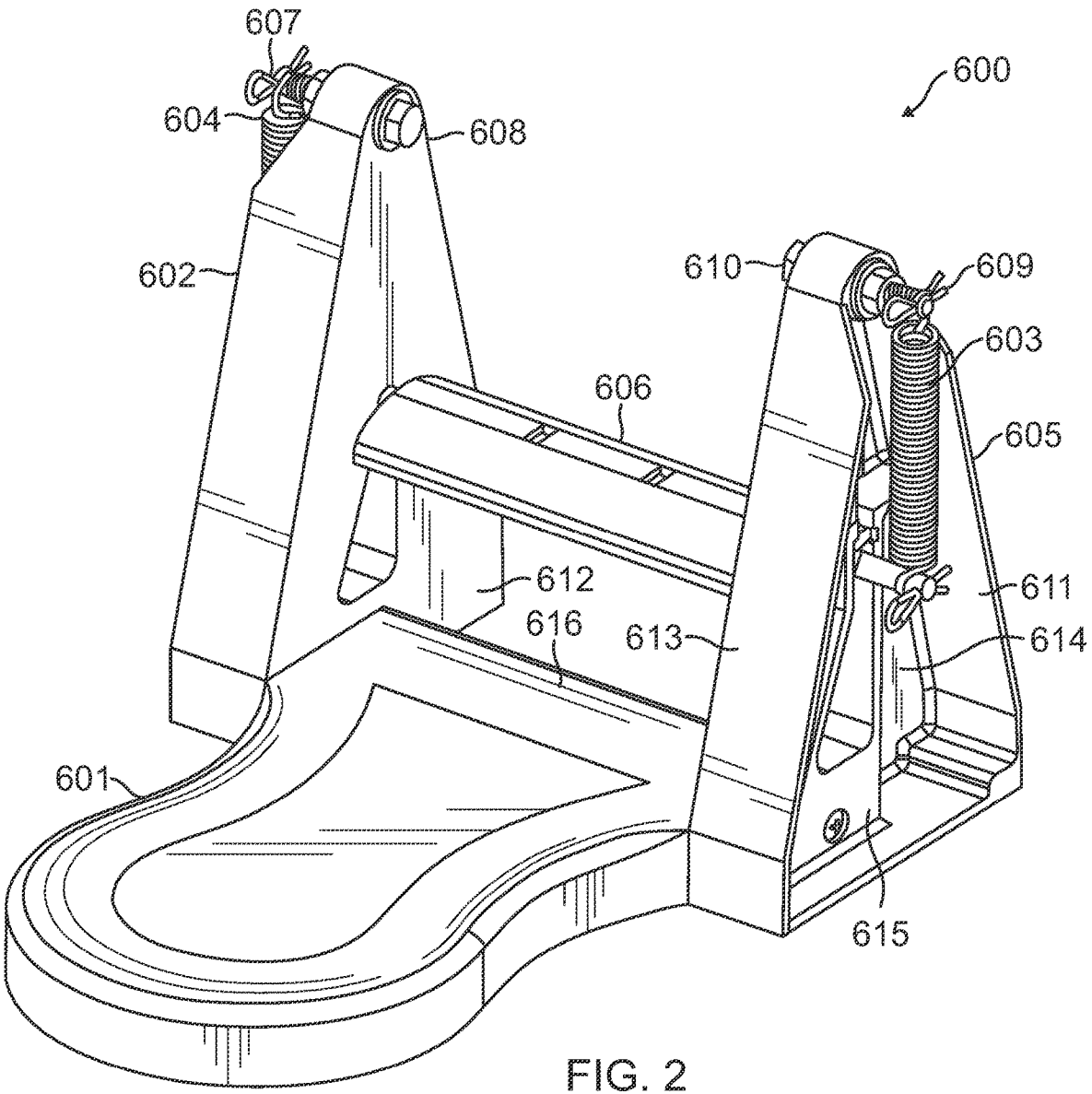
FIG. 2 is a perspective view of an embodiment of the apparatus.

FIG. 2 is a perspective view of an embodiment of the apparatus. The apparatus 600 comprises a base member 601 mounted into triangular side members 602 and 603. The base member 601 is secured to the side members 602 and 603 via a fastening means, such as screw 615 connecting base member 601 to side member 603. A corresponding fastening means (not shown) secures the left side of base member 601 to side member 602. The base member 601 supports the foot of a user and the weight of the user helps keep the entire assembly in place when in use.

Cross member 606 is disposed between side members 602 and 603. A user can place the ball or heel of the foot on cross member 606 and press up and down with the foot, moving cross member up and down in the side members via openings 612 and 613 in side members 602 and 603 respectively. An optional friction surface 616 on base member 601 keeps the heel of the user from sliding backwards or forwards during use.

In one embodiment, the cross member is held in place at an upper position via the urging of springs 604 and 605. Spring 604 is coupled to bolt 608 at the apex of side member 602 via fastening means 607, e.g. a cotter pin, acorn nut, and the like. Spring 605 is coupled to bolt 610 at the apex of side member 603 via fastening means 609, which may also be a cotter pin, acorn nut, and the like.

The base of spring 605 is coupled to shaft 611 which runs through cross member 606 to and through the other side member 602. Spring 605 is coupled to shaft 611 via fastening means 614 which in one embodiment is a cotter pin. Similarly, a fastening means (not shown) couples spring 604 to shaft 611.

The openings 612 and 613 are wider at the bottom than at the top, allowing some play in the cross member when depressed to allow some front and back movement of the foot as desired during operation. As the foot shortens during operation of the apparatus, the cross member 606 is allowed to travel with the foot to the wider part of the bottom of the openings. This allows for a more natural motion during operation.

In one embodiment, one side of each opening is straight up and down, and the other side is angled to urge the shaft to the narrower opening at the top of each opening 612 and 613.

Springs 604 and 605 may be of a desired tension to provide appropriate resistance to the user during use of the apparatus. The springs may be replaced with springs of higher or lower tension as desired for the therapy of the user during the rehabilitation process. In one embodiment, the cotter pins are implemented to allow for ease of use in replacing the springs with other springs of varying tension.

The cross member 606 may be rotatably mounted on shaft 611 so that the cross member rotates during use, allowing a more natural movement by the user during operation. In one embodiment, the uppermost position of the cross member 606 may be adjusted to be lower, such as through the use of set screws and the like, as shown in FIG. 3, to reduce the amount of travel of the cross member 606 during use.

In one embodiment, the springs may be replaced with rubber bands of varying tension secured to the shaft and to the cross member, allowing customized tension and resistance during use. In one embodiment, the springs may be disposed about a vertical shaft with the cross member attached by an adjusting means (e.g. set screw) that can be tightened or loosened to increase or decrease the resistance. In one embodiment, a piston or shock absorber type assembly may replace the springs. The resistance of piston may be adjusted to be higher or lower as desired.

In operation the user may place the heel of the user on base member 601 and the ball of the foot of the user on the cross member 606 and move the foot up and down as part of an exercise. Alternatively, the user may place the heel of the foot on the cross member 606 and the ball and toes on the base member 601, allowing a calf exercise to be performed by the user.

Figure 3:
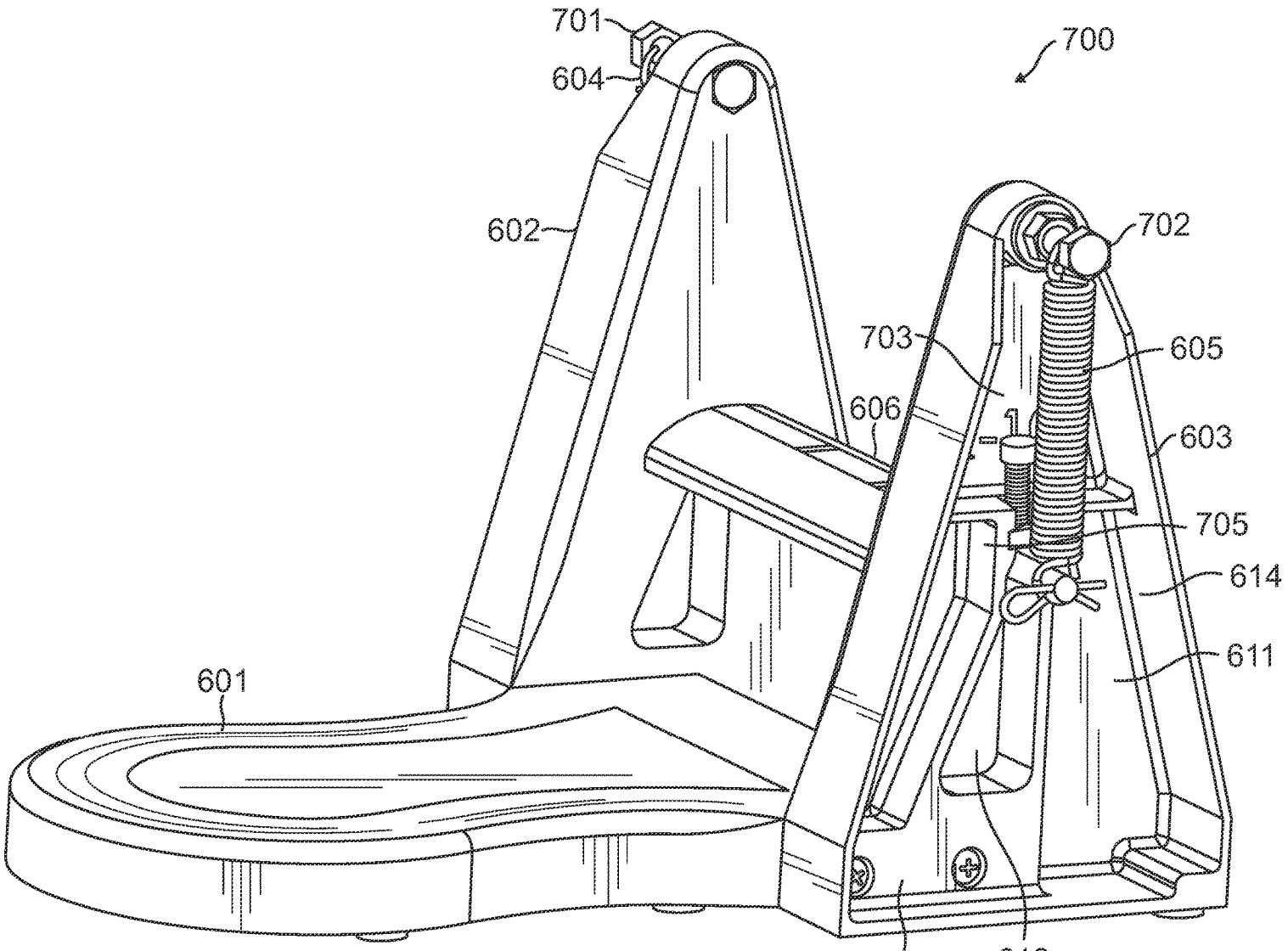
FIG. 3 is a perspective view of an embodiment of the apparatus of FIG. 2.

FIG. 3 is a perspective view of an embodiment of the apparatus of FIG. 6. Like elements have the same element number in FIG. 2 and FIG. 3. The apparatus 700 uses acorn nuts 701 and 702 to hold the top of spring 604 and 605 in place, respectively. A set screw 703 controlling the position of member 705 in slot 613 is used to control the upper limit of travel of cross member 606. The set screw 703 can be turned to cause member 705 to be positioned closer to the bottom of the apparatus, thereby urging shaft 611 and correspondingly cross member 606, to be positioned at a lower level. This allows users to adjust for different size feet and to control the amount of movement during the operation of the apparatus. A similar arrangement (not shown in FIG. 3) is disposed in side member 602 and the set screws can be adjusted independently to set the upper limit of travel of the cross member 606. FIG. 3 also shows that two screws 615 can be used to attach side member 603 to base member 601.

What is claimed is:

1. An apparatus comprising:

a base member;

a first side member coupled to a first side of the base member and a second side member coupled to a second side of the base member; the first and second side members each having a first and second slot formed therein, respectively;

a foot pedal between the first and second side members, coupled to a shaft disposed in said first and second slots and moving up and down within said first and second slots;

a first urgent member coupled to a first side of the shaft and to the first side member, and a second urgent member coupled to a second side of the shaft and to the second side member;

the first and second urgent members urging the shaft and the foot pedal to a first upper position.

2. The apparatus of claim 1 wherein the first and second urgent members comprise first and second springs.

3. The apparatus of claim 1 wherein the first and second urgent members comprise rubber bands.

4. The apparatus of claim 1 wherein the first and second urgent members comprise pistons.

5. The apparatus of claim 1 wherein the length of the first and second slots is configured to be adjusted to control the amount of movement of the foot pedal.

* * * * *